United States Patent [19]

Palone

[11] 4,357,064

[45] Nov. 2, 1982

[54] EQUALIZING ELECTRICAL CONNECTION FOR INSIDE A PIPE

[75] Inventor: Richard D. Palone, West Fork, Ark.

[73] Assignees: Morris Oil Field Supply Co., Morris; Chester Palone, Tulsa, both of Okla.; part interest to each

[21] Appl. No.: 196,844

[22] Filed: Oct. 14, 1980

[51] Int. Cl.[3] ..... H01R 13/62

[52] U.S. Cl. ..... 339/89 R; 339/182 R

[58] Field of Search ..... 285/333; 403/300, 305; 339/15, 16, 89 R, 182 R, 154 L

[56] References Cited

U.S. PATENT DOCUMENTS 3,649,949 3/1972 McCarthy et al. ..... 339/16 R 3,753,206 8/1973 Busuttil et al. ..... 339/16 C 3,871,734 3/1975 Murtland ..... 339/15 X 3,989,330 11/1976 Cullen et al. ..... 339/16 R

*Primary Examiner*—Eugene F. Desmond

*Attorney, Agent, or Firm*—Head, Johnson & Stevenson

[57] ABSTRACT

Means of connecting together lengths of pipe while providing electrical connection between wires in the pipes, including a male connector of insulating material received in one end of a first length of pipe and a female connector of insulating material received in one end of a second length of pipe, the male and female connectors having portions engaging each other providing electrical contacts for connecting the wires within the pipes together, the connectors being under spring compressive force when the lengths of pipe are coupled together.

7 Claims, 9 Drawing Figures

EQUALIZING ELECTRICAL CONNECTION FOR INSIDE A PIPE

BACKGROUND OF THE INVENTION

1. Field of the Invention

This invention relates to an apparatus for providing a means of connecting together two lengths of pipe, each having wires therein in a way such that the wires connect with each other in a manner such that a successive length of pipe may be joined together while maintaining electrical continuity between the wires in the pipes.

2. Description of the Prior Art

The invention is related to a method of connecting lengths of pipe together while at the same time providing continuity between wires within the pipe. As one example of the application of the invention, it is frequently desirable to extend electrical wires to a point in an oil well below the earth's surface. A specific example is that of providing heat to the interior of an oil well being pumped by the well from cooling to the point where paraffin begins to solidify. Reference may be had to U.S. Pat. No. 3,859,503 issued Jan. 7, 1975 which teaches electrically heated sucker rods. In this patent an apparatus is provided whereby electrical energy may be conveyed by successive lengths of sucker rods to a heating element positioned within the well tubing. In the arrangement illustrated in this prior issued patent the heating element is formed of one or more lengths of sucker rods having resistance heating elements therein. While the apparatus described in this prior issued patent works completely satisfactorily for its intended objective, one of the problems with the type of sucker rods illustrated in the patent is that of encapsulating the conductors within the sucker rods. A more useful means of practicing the invention includes the use of small diameter pipe which functions as sucker rods for transmitting reciprocal motion from the earth's surface to a pump positioned in a string of tubing. The conductors necessary to carry energy from the earth's surface to a point in the well can be carried within the small diameter pipe. The problem has existed, however, in providing means of connecting the lengths of pipe together so that continuity is provided between the wires in each successive length of pipe.

It is therefore an object of this invention to provide an improved means of connecting together lengths of pipe while providng electrical connection between wires in the pipes.

A more specific object of the invention is to provide a male and female electrical contact means on the ends of lengths of pipe so that as the ends of adjacent lengths of pipe are joined together, electrical contact is made between conductors carried internally of the pipe in an arrangement wherein spring tension is employed to ensure that the electrical contact is of low resistance when the pipe is joined irrespective of physical differences in the collars or other devices used for connecting the lengths of pipe together.

These general objects as well as other and more specific objects of the invention will be fulfilled in the following description and claims, taken in conjunction with the attached drawings.

SUMMARY OF THE INVENTION

Apparatus is provided for connecting together lengths of pipe while providing electrical connection between wires in each length of pipe. A male connector is provided in the end of one length of pipe and a female connector in the end of the adjacent length of pipe to be joined. The male connector is formed of insulating material. The connector has a first cylindrical portion extending from the end of the pipe and a concentric reduced diameter portion extending further from the end. A first male contact is affixed to the male connector cylindrical portion, the contact having a concentric opening therein which receives the connector reduced diameter portion. A second male contact is affixed to the outer end of the male connector reduced diameter portion. Wires received within the first length of pipe are attached to the first and second male connectors. A female connector of insulating material is positioned in one end of the second length of pipe. The female connector has a larger diameter concentric recess in the exposed end and a smaller diameter concentric recess extending from the larger recess providing an internal shoulder. A first female contact is affixed to the internal shoulder within the female connector, the contact having an opening coaxial with the small diameter recess. A second female contact is received in the female connector smaller diameter recess. Wires received within the second length of pipe are attached to the first and second female connectors. At least one of the male and female connectors is slidably received in the length of pipe in which it is situated. In the preferred arrangement both the male and female connectors are slidably positioned. Spring means is provided to resiliently bias each of the slidably positioned connectors in the direction towards the end of the pipe in which it is positioned. The two lengths of pipe are connected together such as by means of an internally threaded collar, the pipe having threads on the outer circumferential surfaces at the ends thereof so that the lengths of pipe are held together with the male connector extending within the female connector and the male contacts contacting the female contacts with the springs urging the contacts into firm engagement to ensure a low resistance connection of the wires in the first pipe to the wires in the second pipe.

In the preferred arrangement both the male and female connector are resiliently biased towards the ends of the pipe in which they are positioned; and in a still further preferred embodiment, the second female contact is separately resiliently biased to ensure firm engagement of the male and female second contacts.

DESCRIPTION OF THE VIEWS

DETAILED DESCRIPTION

Figure 1:
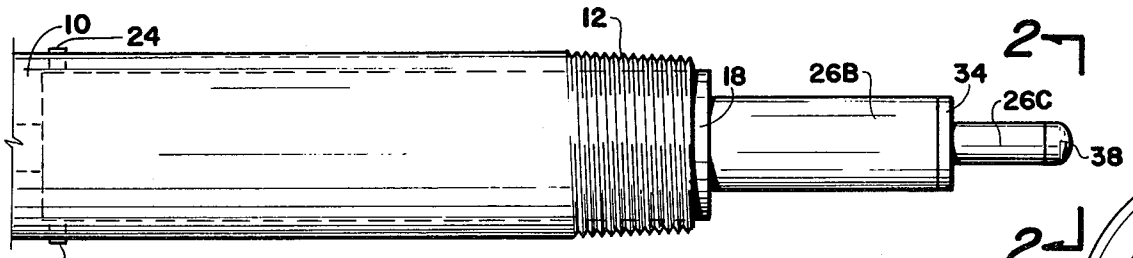
FIG. 1 is an external view of a length of pipe showing a male connector extending therefrom.
Figure 4:
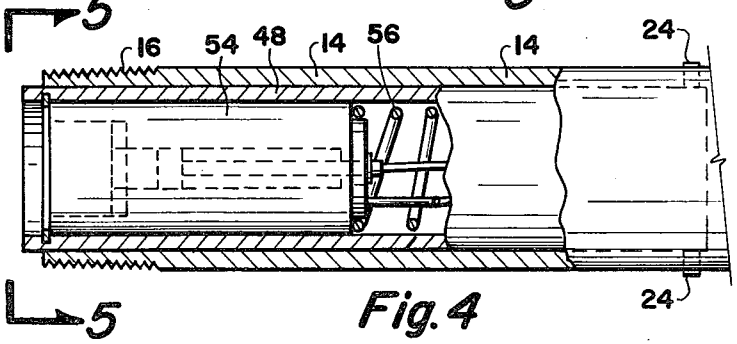
FIG. 4 is an elevational view, shown partially in cross-section, of a length of pipe having a female connector.

Referring to the drawings, FIG. 1 shows a first length of pipe 10 having external threads 12 at one end. FIG. 4 shows a second length of pipe 14 having external threads 16. The objective of the invention is to provide means wherein, when the lengths of pipe 10 and 14 are connected together the wires within the pipes are connected to provide continuity therebetween.

Figure 2:
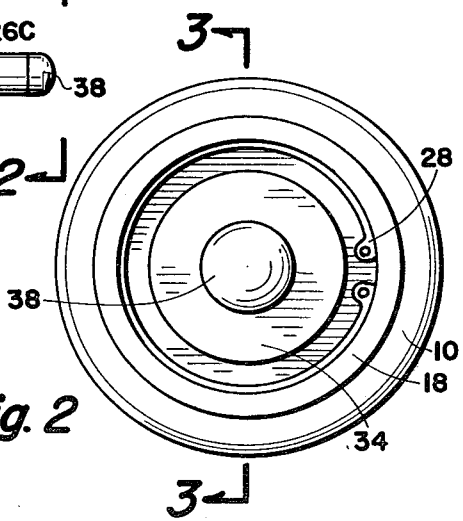
FIG. 2 is an end view of the length of pipe having the male connector as shown in FIG. 1.
Figure 3:
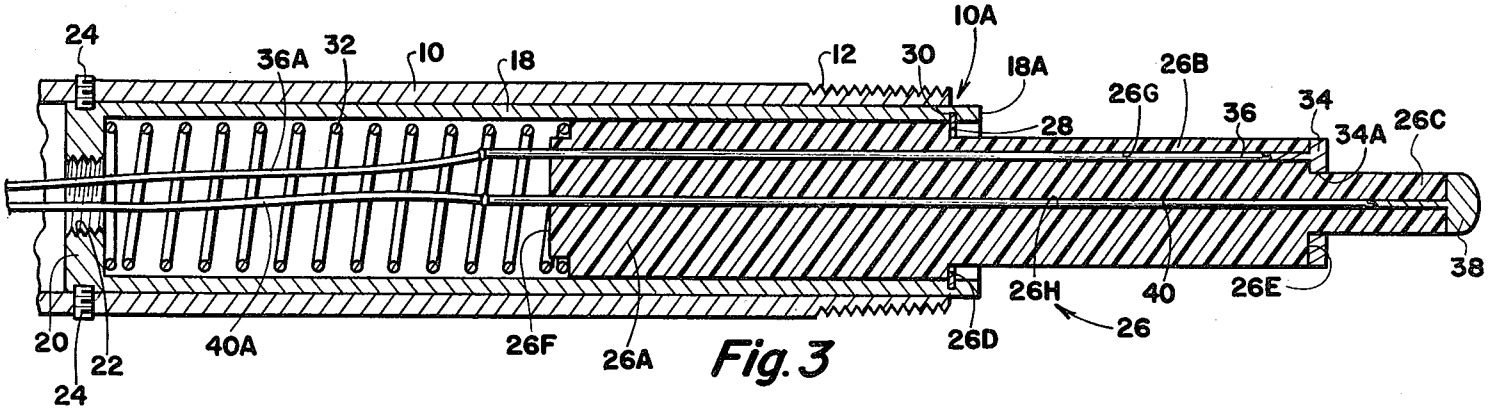
FIG. 3 is a cross-sectional view of the male connector shown in FIG. 1 taken along the line 3—3 of FIG. 2.

The male connector portion will first be described, and this is best shown in FIGS. 1, 2, and 3. Positioned within the end of pipe 10 is a first sleeve 18 which is cylindrical, with the inner end 20 closed, the closed end 20 having an opening 22 therethrough. The sleeve 18 may be supported in the end of pipe 10 such as by welding or, in the preferred arrangement as illustrated, set screws 24 extending through threaded openings in pipe 10 are utilized to hold the sleeve in position.

Slidably received within the first sleeve 18 is a male connector generally indicated by the numeral 26. Connector 26 is of insulating material such as plastic. The inner portion 26A of the male connector has an external diameter slightly less than the internal diameter of sleeve 18 so that it is slidably received in the sleeve. Extending forwardly of the end 10A of the first length of pipe is an integral first cylindrical portion 26B of the male connector which has an external diameter less than the diameter of the inner portion 26A. Extending coaxially from portion 26B is a concentric reduced diameter end portion 26C. The different diameters of the male connector 26 provide a first shoulder 26D at the intersection of portions 26A and 26B, and a second shoulder 26E at the intersection between portions 26B and 26C.

As previously stated, the male connector 26 is slidably positioned within the sleeve 18. To retain it in position, an expandable C-shaped keeper 28 is retained within a circumferential internal slot 30 formed in the interior of the sleeve 18 adjacent the sleeve outer end 18A. Compressibly positioned within the sleeve 18 between the closed end 20A and the rearward end 26F of the male connector is a compression spring 32 which serves to urge the connector in a forward direction, that is, towards the end 10A of the first length of pipe.

Affixed to the connector second shoulder portion 26E is a first male electrical contact element 34 which is in the form of a flat washer-shaped element having an opening 34A therein which receives the connector reduced diameter portion 26C. The contact 34 is of a highly conductive material such as copper. Affixed to it is a first wire 36 which extends through a small diameter opening 26G in the connector. The wire 36 extends rearwardly beyond the connector rearward end 26F and is connected with a flexible wire 36A which extends the full length of pipe 10.

At the outer end of the connector reduced diameter portion 26C is a second male electrical conductive contact 38, formed of conductive material such as copper. Attached to it is the outer end of a second wire 40 received in a small diameter opening 26H. The second wire 40 extends beyond the rearward end 26F of the connector and has attached to it a flexible wire portion 40A which extends the length of pipe 10.

Figure 7:
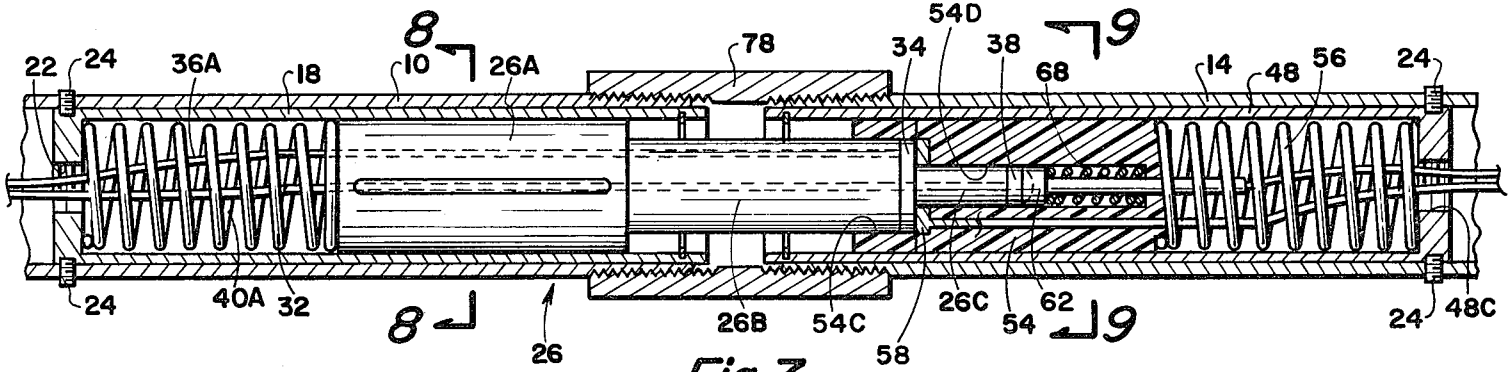
FIG. 7 is a cross-sectional view of a first and second length of pipe coupled together, one pipe having a male connector and the other having a female connector by which wires in each of the pipes are electrically connected to each other.
Figure 8:
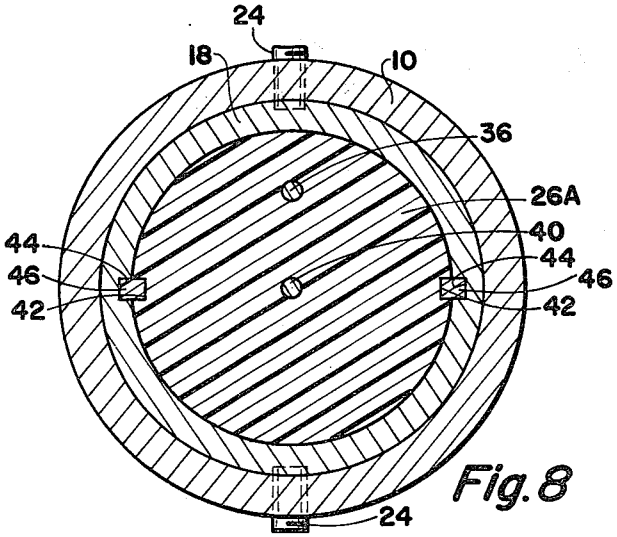
FIG. 8 is a cross-sectional view of the first length of pipe and the male connector therein taken along the line 8—8 of FIG. 7.

As shown in FIGS. 7 and 8, the connector inner portion 26A is provided with opposed longitudinal slots 42 in a plane of the conductor cylindrical axis. In like manner, sleeve 18 has opposed slots 44 in the plane of the sleeve cylindrical axis. Positioned within the area formed by slots 42 and 44 on each side of the connector inner portion 26A are keys 46 which serve to permit the connector 26 to slide within sleeve 18. Thus the keys 46 prevent the male connector 26 from rotating as lengths of pipe are threaded into engagement with each other, thereby preventing wires 36A and 40A from being twisted.

Figure 5:
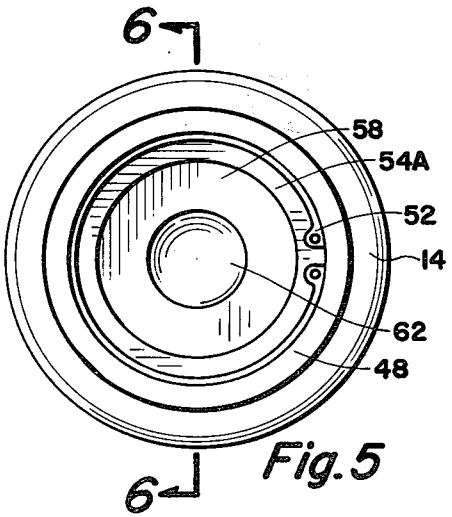
FIG. 5 is an end view of the length of pipe with the female connector as taken along the line 5—5 of FIG. 1.
Figure 6:
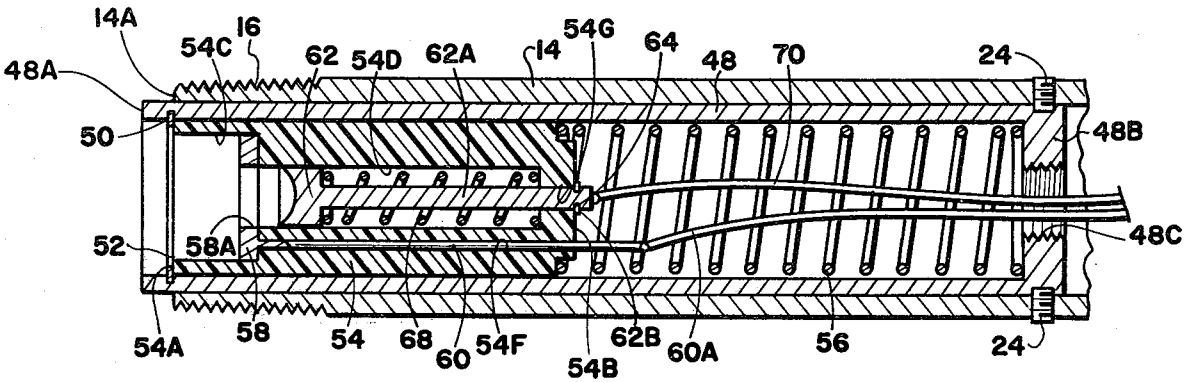
FIG. 6 is a cross-sectional view of the end of a second length of pipe having the female connector therein as taken along the line 6—6 of FIG. 5.

Referring now to FIGS. 4, 5, and 6, the details of the construction of the connector arrangement for the end of a second length of pipe 14 are illustrated. Slidably positioned within the second length of pipe 14 is a second sleeve 48 having an outer end 48A and a closed inner end 48B. The closed end has an opening 48C therein. Sleeve 48 is of the same construction as sleeve 18 previously described. Sleeve 48 is held in position in the end of second pipe 14 by set screws 24. The second sleeve 48 has a slot 50 adjacent the sleeve outer end 48A which receives a C-shaped expandable keeper 52.

Slidably received in the second sleeve 48 is a female connector 54 which is of non-conductive material, such as plastic or ceramic, and is slidably positioned within the sleeve by the external diameter thereof being slightly less than the interior diameter of the sleeve. The female connector 54 has a forward end 54A and a rearward end 54B. A spring 56 is positioned within the sleeve and compressibly extends between the female connector rearward end 54B and the sleeve closed end 48B.

Female connector 54 has a larger diameter concentric recess 54C therein at the sleeve forward end 54A and a smaller diameter concentric recess 54D extending therefrom. The juncture of recess 54C and 54D provides an internal shoulder 54E which has affixed to it a first female electrically conductive contact member 58. The first contact 58 has an opening 58A therein which is concentric with the conductor smaller diameter recess 54D. A first wire 60 is received in a small diameter opening 54F. Wire 60 is attached at its outer end to contact 58 and extends beyond the rearward end 54B of the female connector where a flexible wire 60A is attached to it, the flexible wire extending the full length of the second length of pipe 14.

The rearward end 54B of the female connector has a small diameter opening 54G therein. Slidably received in the female connector smaller diameter recess 54D is a second female connector 62 which has a reduced diameter integral portion 62A which extends rearwardly through the female connector small diameter opening 54G. A C-shaped keeper 64 positioned in an external circumferential recess 62B retains the second female contact 62 within the connector recess 54. A spring 68 is compressibly positioned within the connector small diameter recess 54 between the second female connector 62 and the rearward end of the connector to resiliently urge the second female connector 62 in the forward direction, that is, towards the pipe end 14A. A second flexible wire 70 is attached to the rearward end of the second female contact reduced diameter portion 62A. Wires 60A and 70 extend through opening 48C in the sleeve closed end portion and the full length of the second pipe 14.

The description to this point has been predicated upon a male connector being positioned at one end of the first length of pipe 10 and a female connector at one end of a second length of pipe 14. In actual practice, the typical arrangement is that as to each length of pipe, a female connector is at one end and a male connector at the other end, in which case conductor 70 of FIG. 6 and conductor 40A of FIG. 3 would be the same, and in like manner, conductor 60A of FIG. 6 would be the same as conductor 34A of FIG. 3.

Figure 9:
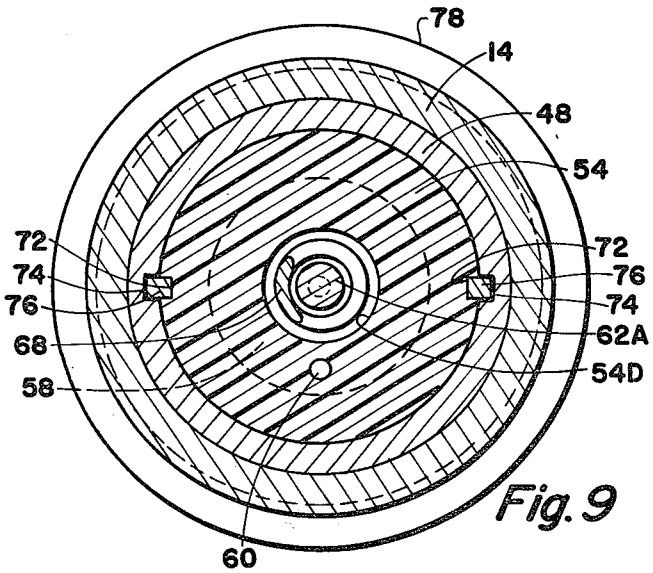
FIG. 9 is a cross-sectional view of the second length of pipe and the female connector therein taken along the line 9—9 of FIG. 7.

Referring to FIG. 9, it can be seen that the female connector 54 has opposed slots 72 therein in a plane of the connector tubular axis and the second sleeve 48 has corresponding slot 74. Positioned in the slots are elongated rectangular cross-sectioned keys 76 which permit the female connector 54 to slide within sleeve 48 but prevents it from rotating.

FIG. 7 is a cross-sectional view showing the male and female connectors connected to each other as the first length of pipe 10 is connected to the second length of pipe 14 by means of an internally threaded collar or coupling 78. This is illustrated as one means whereby the lengths of pipe 10 and 14 may be joined. It can be seen that other means may be employed such as one of the lengths of pipe having an integral internally threaded portion to receive the male threaded portion of the other length of pipe.

As the lengths of pipe 10 and 14 are secured together in axial end-to-end arrangements, the pipes are aligned with each other and moved towards each other, the male connector extends within the female connector with the male connector portion 26B received within the female connector larger recess 54C and the male connector reduced diameter portion 26C being received in the female connector small recess 54D. First male contact 34 thereby engages first female contact 58 and second male contact 38 engages the second female contact 62. As the coupling 78 is threaded onto the two lengths of pipe to connect them together, one or the other, or both of the lengths of pipe 10 and 14 are rotated relative to each other to fully thread the pipe into both ends of coupling 78. The cylindrical configuration of the male and female connectors allows rotation to take place, but the connectors themselves are prevented from rotating so that the wires are not twisted within the pipe. As the lengths of pipe move towards each other in the coupling operation, springs 32 and 56 allow for slidable displacement of the male and female connectors. The connectors are dimensioned such that when the pipes 10 and 14 are fully threaded together the connectors will be slidably inwardly depressed by compression of springs 32 and 34. This ensures firm preselectable compressive force of the first male contact 34 against the first female contact 58 to thereby ensure low resistance contact between wire 36A in first length of pipe 10 and wire 60A in second length of pipe 14. In like manner, the engagement of the second male connector 38 with the second female connector 62 causes spring 68 to compress, thereby ensuring a preselected compressive force against these two contacts to ensure a low resistance continuity between wires 40A and 70.

By the arrangement of this invention, successive lengths of pipe may be joined together, each pipe having a male connector on one end and female connector on the other so that a string of pipe as long as desired may be assembled affording electrical carrying capacity of wires within the pipes. This arrangement is particularly useful in installing pipes in a pumping well wherein the pipes function as sucker rods while allowing means of conducting electrical energy to a point within the well. This electrical energy may be utilized for purposes of providing signalling information from within the well to the surface or providing electrical power such as to heating elements (not shown) whereby heat may be applied within the well to reduce the formation of paraffin.

The arrangement of the invention is such that any imperfections in the threads 12 and 16 on the ends of the pipe and coupling 78 do not interfere with a firm, reliable, and predictable transfer of electrical continuity from wires within one length of pipe to wires within another length of pipe.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification but is to be limited only by the scope of the attached claim or claims including the full range of equivalency to which each element thereof is entitled.

What is claimed is:

1. Apparatus providing means of connecting together lengths of pipe while providing electrical connection between wires in each length of pipe comprising:

a first length of pipe;

a first sleeve received in one end of said first length of pipe, the sleeve having an outer end and an inner end, the outer end being adjacent the end of the length of pipe and the inner end having an internal shoulder;

a male connector of insulating material having an inner portion slidably received in said sleeve and an outer portion having a first cylindrical portion and a concentric reduced diameter end portion;

a spring within said sleeve compressibly positioned between said sleeve shoulder and said male connector;

a first male electrically conductive contact member affixed to the outer end of said male connector outer portion, the contact member having an opening therein receiving said reduced diameter portion;

a second male electrically conductive contact member affixed to the outer end of said male connector reduced diameter end portion;

conductors affixed to each of said first and second male contact members and extending within said first length of pipe;

a second length of pipe;

a second sleeve received in one end of said second length of pipe, the sleeve having an outer end and an inner end, the outer end being adjacent the end of the length of pipe and the inner end having an internal shoulder;

a female connector having an inner and outer end, the connector being of insulating material having a larger diameter concentric recess in one end and a smaller diameter concentric recess extending therefrom providing an internal shoulder, the larger diameter recess being at the connector outer end, the connector being slidably positioned in said second sleeve;

a spring positioned within said second sleeve compressibly extending between said connector inner end and said sleeve internal shoulder;

a first female electrically conductive contact member affixed to said internal shoulder of said female connector, the contact member having an opening therein coaxial with said smaller diameter recess;

a second female electrically conducting contact member received in said female connector smaller diameter recess;

conductors affixed to each of said first and second female contact members and extending within said second length of pipe;

means of removably connecting the end of said first length of pipe to the end of said second length of pipe;

whereby said first and second pipes may be connected end-to-end with said male connector reduced diameter portion telescopically received within said female connector smaller diameter recess with said second male contact in engagement with said second female contact, and said male connector cylindrical portion telescopically received within said female connector larger diameter recess with said first male contact in engagement with said first female contact to thereby provide continuity between the conductors in said first length of pipe with said conductors in said second length of pipe.

2. Apparatus according to claim 1 wherein said second female contact member is slidably received in said female connector smaller diameter recess, and including a smaller diameter spring compressibly received in said female connector smaller diameter recess urging said second female contact member towards said second sleeve outer end.

3. Apparatus according to claim 1 wherein the ends of said first and second lengths of pipe are threaded, and wherein said means of removably connecting the lengths of pipe together includes an internally threaded collar.

4. Apparatus providing means of connecting together lengths of pipe while providing electrical connection between wires in each length of pipe comprising:

a male connector of insulating material received in one end of a first length of pipe, the connector having a first cylindrical portion extending from the end of the pipe and a concentric reduced diameter portion extending therefrom;

a first male contact affixed to said male connector cylindrical portion and having a concentric opening therein receiving said connector reduced diameter portion;

a second male contact affixed to the outer end of said male connector reduced diameter portion;

wires received within said first length of pipe being attached to said first and second male contacts;

a female connector of insulating material received in one end of a second length of pipe, the connector having a larger diameter concentric recess in one end and smaller diameter concentric recess extending therefrom and providing an internal shoulder;

a first female contact member affixed to said internal shoulder of said female connector, the contact member having an opening therein coaxial with said smaller diameter recess;

a second female contact member received in said female connector smaller diameter recess;

wires received within said second length of pipe and attached to said first and second female connectors;

at least one of said male and female connectors being slidably received in the length of pipe in which it is situated and including spring means resilient biasing the slidably positioned connector in the direction towards the end of the pipe in which it is positioned; and means of removably connecting the two lengths of pipe together whereby the male connector is received in the female connector and the male contacts engage the female contacts under force supplied by the compression of said spring.

5. Apparatus according to claim 4 wherein both said male and female connectors are slidably received in the ends of lengths of pipe in which they are positioned and including a spring means in each length of pipe resiliently biasing each of said connectors in the direction towards the end of the pipe in which each connector is positioned.

6. Apparatus according to claim 4 wherein said second female contact member is slidably received in said female connector smaller diameter recess, and including a smaller diameter spring compressibly received in said female connector smaller diameter recess urging said second female contact member towards said second sleeve outer end.

7. Apparatus according to claim 4 wherein the ends of said first and second lengths of pipe are threaded, and wherein said means of removably connecting the lengths of pipe together includes an internally threaded collar.

* * * * *